US010921051B2

(12) United States Patent
Stout et al.

(10) Patent No.: US 10,921,051 B2
(45) Date of Patent: Feb. 16, 2021

(54) ILLUMINATED SHELF FOR REFRIGERATOR APPLIANCE

(71) Applicant: Haier US Appliance Solutions, Inc., Wilmington, DE (US)

(72) Inventors: Mark Allen Stout, Elberfeld, IN (US); David Meese, Evansville, IN (US); Natasha Hamill, Madison, AL (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 106 days.

(21) Appl. No.: 16/111,308

(22) Filed: Aug. 24, 2018

(65) Prior Publication Data

US 2020/0064057 A1 Feb. 27, 2020

(51) Int. Cl.

| | |
|---|---|
| ***F25D 25/02*** | (2006.01) |
| ***F25D 11/02*** | (2006.01) |
| ***F25D 27/00*** | (2006.01) |

(52) U.S. Cl.

CPC ..... *F25D 25/02* (2013.01); *F25D 11/02* (2013.01); *F25D 27/00* (2013.01); *F25D 2325/022* (2013.01); *F25D 2327/00* (2013.01)

(58) Field of Classification Search

CPC ..... F25D 25/02; F25D 27/00; F25D 11/02; F25D 2325/022; F25D 2327/00

USPC ..... 62/264

See application file for complete search history.

(56) References Cited

U.S. PATENT DOCUMENTS

| | | | | |
|---|---|---|---|---|
| 2,515,584 | A | 7/1950 | Benson | |
| 2008/0236183 | A1 | 10/2008 | Iimura | |
| 2015/0023000 | A1 | 1/2015 | Kendall et al. | |
| 2015/0292795 | A1* | 10/2015 | Shin | F25D 25/02 312/404 |
| 2016/0123655 | A1* | 5/2016 | Chow | F25D 23/067 312/404 |

* cited by examiner

*Primary Examiner* — Steve S Tanenbaum
(74) *Attorney, Agent, or Firm* — Dority & Manning, P.A.

(57) ABSTRACT

A refrigerator appliance includes a an insulated cabinet defining a chilled food storage chamber within an interior thereof. An illuminated chamber is defined within the cabinet and is optically separated from the chilled food storage chamber by a wall of the chilled food storage chamber. At least one light source is positioned to emit light into the illuminated chamber. A shelf is selectively mountable in one of a plurality of positions within the food storage chamber. The shelf includes a light-transmitting body. The light-transmitting body of the shelf is in optical communication with the illuminated chamber when the shelf is mounted within the food storage chamber, such that light from the light source of the illuminated chamber travels through the light-transmitting body. As a result, an edge of the shelf is illuminated by the light.

18 Claims, 7 Drawing Sheets

ILLUMINATED SHELF FOR REFRIGERATOR APPLIANCE

FIELD OF THE INVENTION

The present disclosure is related generally to refrigerator appliances, and more particularly to refrigerator appliances that include adjustable shelves which are illuminated using one main source of light.

BACKGROUND OF THE INVENTION

Certain conventional refrigerator appliances include adjustable shelves that can be moved from one shelf mounting position to another within the refrigerator appliance. In some instances, adjustable shelves are mounted to powered tracks so that power can be provided to the shelves for shelf lighting, temperature control, and/or other desirable features which are provided by electronic components on-board each shelf. Powered tracks are generally configured to provide power to adjustable shelves no matter their mounting position within the refrigerator appliance. In this way, the configuration of shelves within the refrigerator can be arranged to suit the needs of a user without loss of powered functionality.

Shelves with on-board electronics generally require more time to assemble and include more parts than non-powered shelves. For example, three or more such selves may be provided, each of which includes its own power supply, PCB, and other components, such as LEDS. Thus, the production time and costs to build these types of shelves for refrigerator appliances is increased. Moreover, conventional adjustable shelves with on-board electronics generally do not offer robust or reliable electrical connections with powered tracks to which they may be mounted. Accordingly, the power delivered to the shelves may be disrupted, causing inconvenience to the user.

Accordingly, improved refrigerator appliances that address one or more of the above challenges are desirable.

BRIEF DESCRIPTION OF THE INVENTION

Aspects and advantages of the invention will be set forth in part in the following description, or may be apparent from the description, or may be learned through practice of the invention.

In accordance with one embodiment, a refrigerator appliance is disclosed. The refrigerator appliance defines a vertical direction, a lateral direction, and a transverse direction. The vertical, lateral and transverse directions are mutually perpendicular. The refrigerator appliance includes an insulated cabinet which extends from a top to a bottom along the vertical direction. The cabinet also extends from a left side to a right side along the lateral direction and from a front to a back along the transverse direction. A chilled food storage chamber is defined within an interior of the insulated cabinet. An opening for receipt of food items is defined in a front portion of the chilled food storage chamber, and a rear wall is defined in a back portion of the chilled food storage chamber. An illuminated chamber is defined within the cabinet behind the rear wall. The illuminated chamber is optically separated from the food storage chamber by the rear wall. The illuminated chamber includes at least one light source positioned to emit light into the illuminated chamber. A shelf is selectively mountable in one of a plurality of positions within the food storage chamber. The shelf includes a light-transmitting body. The light-transmitting body of the shelf is in optical communication with the illuminated chamber through the rear wall when the shelf is mounted within the food storage chamber, such that light from the light source of the illuminated chamber travels through the light-transmitting body. As a result of the light-transmitting body being in optical communication with the illuminated chamber such that the light travels through the light-transmitting body, an edge of the shelf is illuminated by the light.

In accordance with another exemplary embodiment, a refrigerator appliance is disclosed. The refrigerator appliance includes a an insulated cabinet defining a chilled food storage chamber within an interior of the insulated cabinet. An illuminated chamber is defined within the cabinet. The illuminated chamber is optically separated from the chilled food storage chamber by a wall of the chilled food storage chamber. At least one light source is positioned to emit light into the illuminated chamber. A shelf is selectively mountable in one of a plurality of positions within the food storage chamber. The shelf includes a light-transmitting body. The light-transmitting body of the shelf is in optical communication with the illuminated chamber when the shelf is mounted within the food storage chamber, such that light from the light source of the illuminated chamber travels through the light-transmitting body. As a result of the light-transmitting body being in optical communication with the illuminated chamber such that the light travels through the light-transmitting body, a first edge of the shelf is illuminated by the light.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
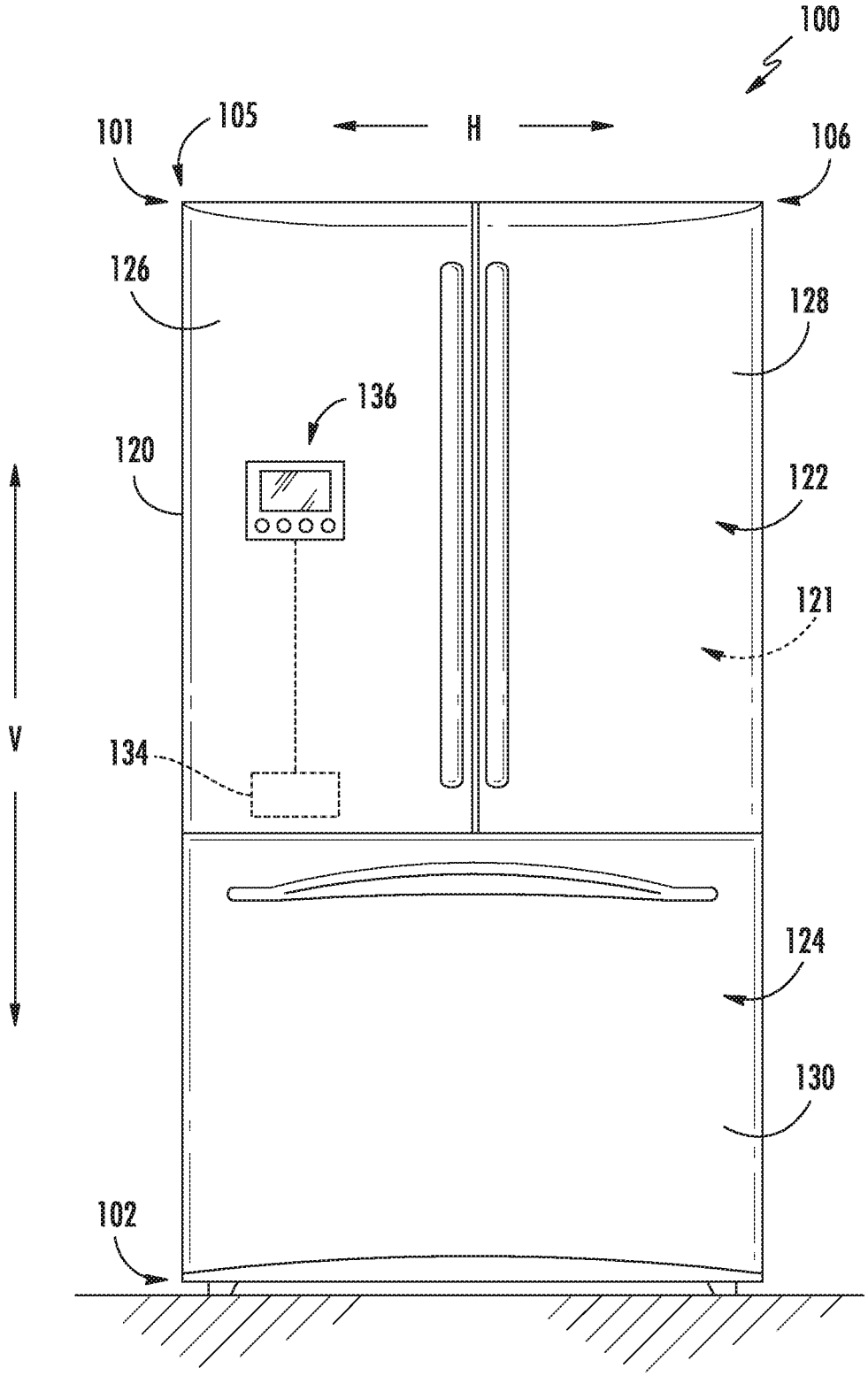
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

FIG. 1 provides a front view of a refrigerated appliance according to an exemplary embodiment of the present subject matter. In the illustrated embodiment, the refrigerated appliance is refrigerator appliance 100 including both a fresh food storage chamber 122 and a freezer chamber 124. In various embodiments, the refrigerated appliance may be a refrigerator appliance or a freezer appliance that includes at least one chilled chamber for storing food, e.g., either one or both of the fresh food chamber 122 and the freezer chamber 124. Refrigerator appliance 100 extends between a top 101 and a bottom 102 along a vertical direction V. Refrigerator appliance 100 also extends between a first side 105 and a second side 106 along a horizontal direction H. A transverse direction T (FIG. 2) is defined perpendicular to the vertical and horizontal directions V, H. Accordingly, vertical direction V, horizontal direction H, and transverse direction T are mutually perpendicular and form an orthogonal direction system.

Refrigerator appliance 100 includes a housing or cabinet 120 defining a volume 121. Cabinet 120 also defines the fresh food chamber 122 and the freezer chamber 124 arranged below the fresh food chamber 122 along the vertical direction V. As such, refrigerator appliance 100 is generally referred to as a bottom mount refrigerator. In this exemplary embodiment, cabinet 120 also defines a mechanical compartment (not shown) for receipt of a sealed cooling system (not shown). It will be appreciated that the present subject matter can be used with other types of refrigerated appliances, e.g., standalone refrigerator appliances (refrigerated appliances having a single food storage chamber configured for storing fresh food items at temperatures greater than zero degrees Celsius (0° C.)), top mount refrigerator appliances, side-by-sides, standalone freezer appliances, and/or other types of appliances more generally. Consequently, the description set forth herein is for exemplary purposes only and is not intended to limit the scope of the present subject matter in any aspect.

Refrigerator appliance 100 includes refrigerator doors 126, 128 that are rotatably hinged to an edge of cabinet 120 for accessing fresh food chamber 122. It should be noted that while doors 126, 128 are depicted in a "French door" configuration, any suitable arrangement or number of doors is within the scope and spirit of the present subject matter. A freezer door 130 is arranged below refrigerator doors 126, 128 for accessing freezer chamber 124.

Operation of refrigerator appliance 100 can be regulated by a controller 134 that is operatively coupled to a user interface panel 136. Panel 136 provides selections for user manipulation of the operation of refrigerator appliance 100 such as e.g., interior shelf lighting settings. In response to user manipulation of user interface panel 136, controller 134 operates various components of refrigerator appliance 100. Controller 134 may include a memory and one or more processors, microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

Controller 134 may be positioned in a variety of locations throughout refrigerator appliance 100. In the illustrated embodiment, controller 134 is located within door 126. In such an embodiment, input/output ("I/O") signals may be routed between the controller and various operational components of refrigerator appliance 100. In one embodiment, user interface panel 136 may represent a general purpose I/O ("GPIO") device or functional block. The user interface 136 may include input components, such as one or more of a variety of electrical, mechanical or electro-mechanical input devices including rotary dials, push buttons, and touch pads. User interface 136 may include a display component, such as a digital or analog display device designed to provide operational feedback to a user. The user interface 136 may be in communication with controller 134 via one or more signal lines or shared communication busses.

Figure 2:
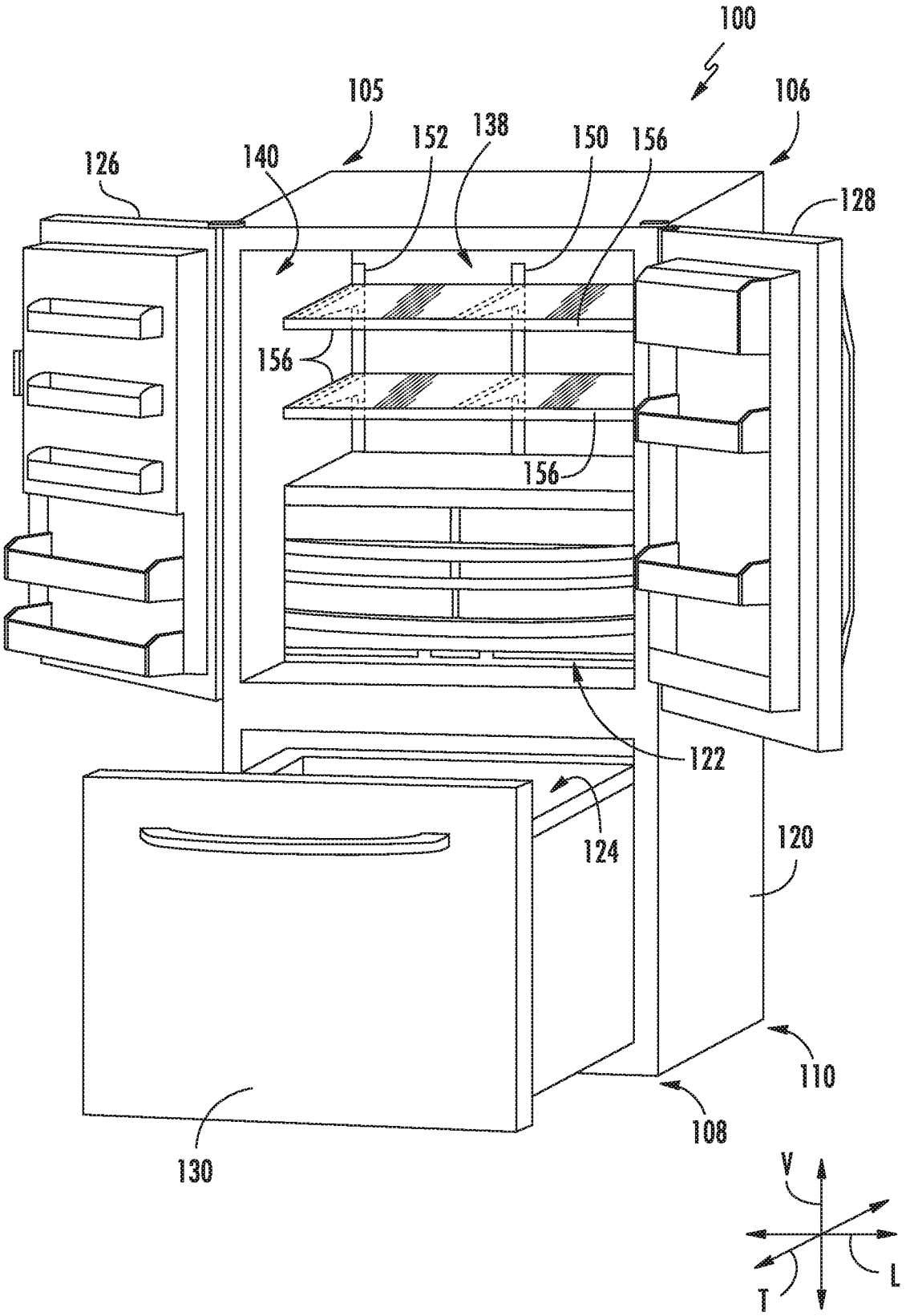
FIG. 2 provides a front perspective view of the refrigerator appliance of FIG. 1 with refrigerator doors and a freezer door shown in an open configuration to reveal a fresh food chamber and freezer chamber of the refrigerator appliance according to an exemplary embodiment of the present subject matter.

FIG. 2 provides a front, perspective view of refrigerator appliance 100 having refrigerator doors 126, 128 in an open position to reveal the interior of fresh food chamber 122. Additionally, freezer door 130 is shown in an open position to reveal the interior of freezer chamber 124. As shown more clearly in FIG. 2, refrigerator appliance 100 extends in the transverse direction T between a front end 108 and a rear end 110.

As shown in FIG. 2, for this exemplary embodiment, fresh food chamber 122 of refrigerator appliance 100 includes a center track 150 and a side track 152, mounted to a rear wall 138 of cabinet 120. Side track 150 is oriented generally along the vertical direction V and proximate one of the first and second sides 105, 106 of refrigerator appliance 100. In the example illustrated by FIG. 2, only one side track 152 is visible; nevertheless, those of ordinary skill in the art will understand an additional side track may be provided, e.g., positioned proximate the second side 106 of refrigerator appliance 100, which is not visible in FIG. 2 but which is the same as the illustrated side track 152, apart from its location.

Center track 150 is oriented along the vertical direction V and positioned between the side tracks 152. In alternative embodiments, some or all of the center track 150 and the one or more side tracks 152 could be mounted to another surface within the interior of cabinet 120, such as to one of the sidewalls 140 of cabinet 120 or in the freezer chamber 124.

One or more adjustable shelves 156 are mounted to the tracks 150 and 152. In the example embodiment depicted in FIG. 2, four (4) adjustable shelves 156 are mounted within fresh food chamber 122 and are arranged in two columns and two rows as shown. In various embodiments, any suitable number of adjustable shelves 156 may be provided in the fresh food chamber 122 and/or the frozen food chamber 124. For example, in embodiments where the refrigerated appliance is a standalone freezer, the adjustable shelves 156 may be provided in a freezer chamber thereof. In such examples, the standalone freezer may consist of a single food storage chamber, configured as a freezer chamber for storing frozen items at temperatures less than or equal to zero degrees Celsius (0° C.). As another example, in embodiments where the refrigerated appliance is a side-by-side refrigerator, the adjustable shelves 156 may be provided in both the fresh food chamber and the freezer chamber.

Adjustable shelves 156 may be selectively positioned by a user in a selected one of a plurality of different shelf mounting positions within fresh food chamber 122. For instance, one adjustable shelf 156 could be removed from its position and moved vertically upward or downward along the vertical direction V or moved from a position proximate first side 105 to a position proximate second side 106 of refrigerator appliance 100 along the horizontal direction H. Adjustable shelves 156 can also be removed from refrigerator appliance 100. For example, if storage room is needed for a particularly tall pot, adjustable shelves 156 can be removed from refrigerator appliance 100 and stowed elsewhere. Although four (4) adjustable shelves 156 are depicted in FIG. 2, more or less than four (4) adjustable shelves 156 can be provided in refrigerator appliance 100.

Figure 3:
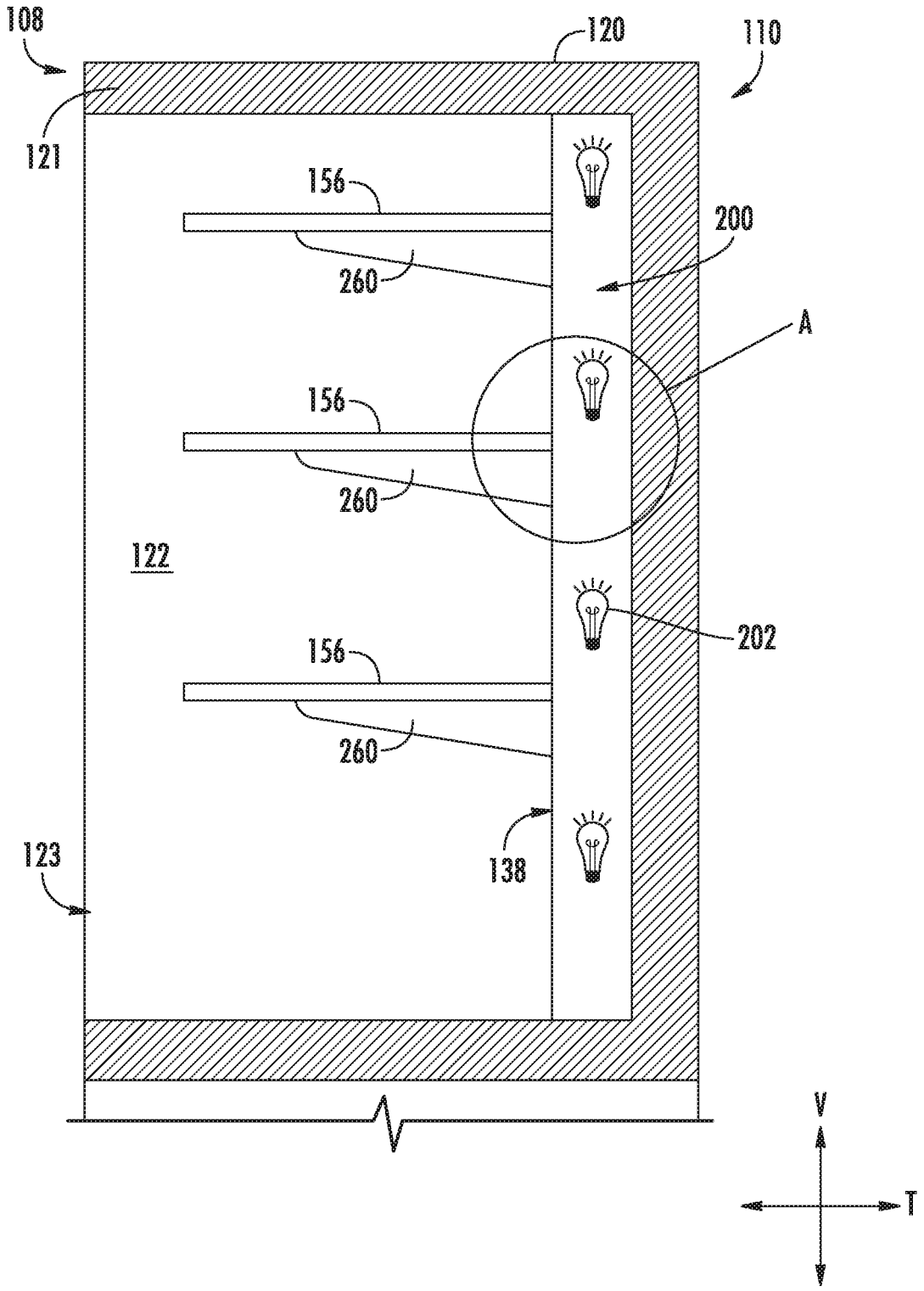
FIG. 3 provides a side section view of a cabinet of the refrigerator appliance of FIG. 1 according to an exemplary embodiment of the present subject matter.

FIG. 3 provides a side section view of a portion of the cabinet 120 of the refrigerator appliance 100. As may be seen in the section view of FIG. 3, the cabinet 120 is an insulated cabinet with thermal insulation 121 provided within an interior of the cabinet 120 and surrounding the chilled food storage chamber, e.g., the fresh food storage chamber 122 in the illustrated embodiment. The cabinet 120 includes an opening 123 providing access to the fresh food storage chamber 122, e.g., for receipt of food items therein. The opening 123 is defined in the front portion 108 of the cabinet 120. Each adjustable shelf 156 includes at least one bracket 260 attached to or formed integrally with adjustable shelf 156 for mounting adjustable shelf 156 to the tracks 150 and 152 in one of the shelf mounting positions. Also as may be seen in FIG. 3, an illuminated chamber 200 is defined within the cabinet 120 behind the rear wall 138, e.g., the illuminated chamber 200 may be behind the rear wall 138 in that the illuminated chamber 200 is positioned between the rear wall 128 and the back end 110 of the cabinet 120 along the transverse direction T. The illuminated chamber 200 is optically separated from the fresh food storage chamber 122 by the rear wall 138. For example, in various embodiments as described in more detail below, the rear wall 138 may include a material that is at least partially opaque or semi-transparent, such that light from the illuminated chamber 200 is prevented or inhibited from travelling into the fresh food chamber 122 by the rear wall 138.

As illustrated for example in FIG. 3, the illuminated chamber 200 is generally coextensive with the fresh food chamber 122, e.g., at least along the vertical direction V, and in some embodiments along the vertical direction V and the lateral direction L. In other embodiments, the illuminated chamber 200 may span both the fresh food storage chamber 122 and the freezer chamber 124, and the adjustable shelves 156 may be selectively mountable within the fresh food storage chamber 122 or the freezer chamber 124. For example, as mentioned above, in some embodiments, the refrigerated appliance may be a side-by-side refrigerator appliance, with the fresh food chamber 122 and the freezer chamber 124 generally coextensive along the vertical direction V and adjacent one another along the lateral direction L. In such embodiments, the illuminated chamber 200 may span the fresh food storage chamber 122 and the freezer chamber 124 along the lateral direction L.

As may be seen in FIG. 3, the illuminated chamber 200 comprises at least one light source 202 positioned to emit light into the illuminated chamber 200, e.g., the at least one light source 202 may be positioned in the illuminated chamber 200 or in optical communication with the illuminated chamber 200. In the example illustrations of FIGS. 3 through 7, the light sources 202 are schematically depicted as incandescent light bulbs, however, this depiction is diagrammatic and for purposes of example only. Any suitable light source 202 may be provided in various embodiments, such as but not limited to LEDs, fluorescent bulbs including CFL bulbs, or combinations thereof. For example, LEDs and/or CFL bulbs may advantageously provide reduced power consumption and more suitable thermal output for use in a chilled chamber as compared to incandescent bulbs.

Figure 4:
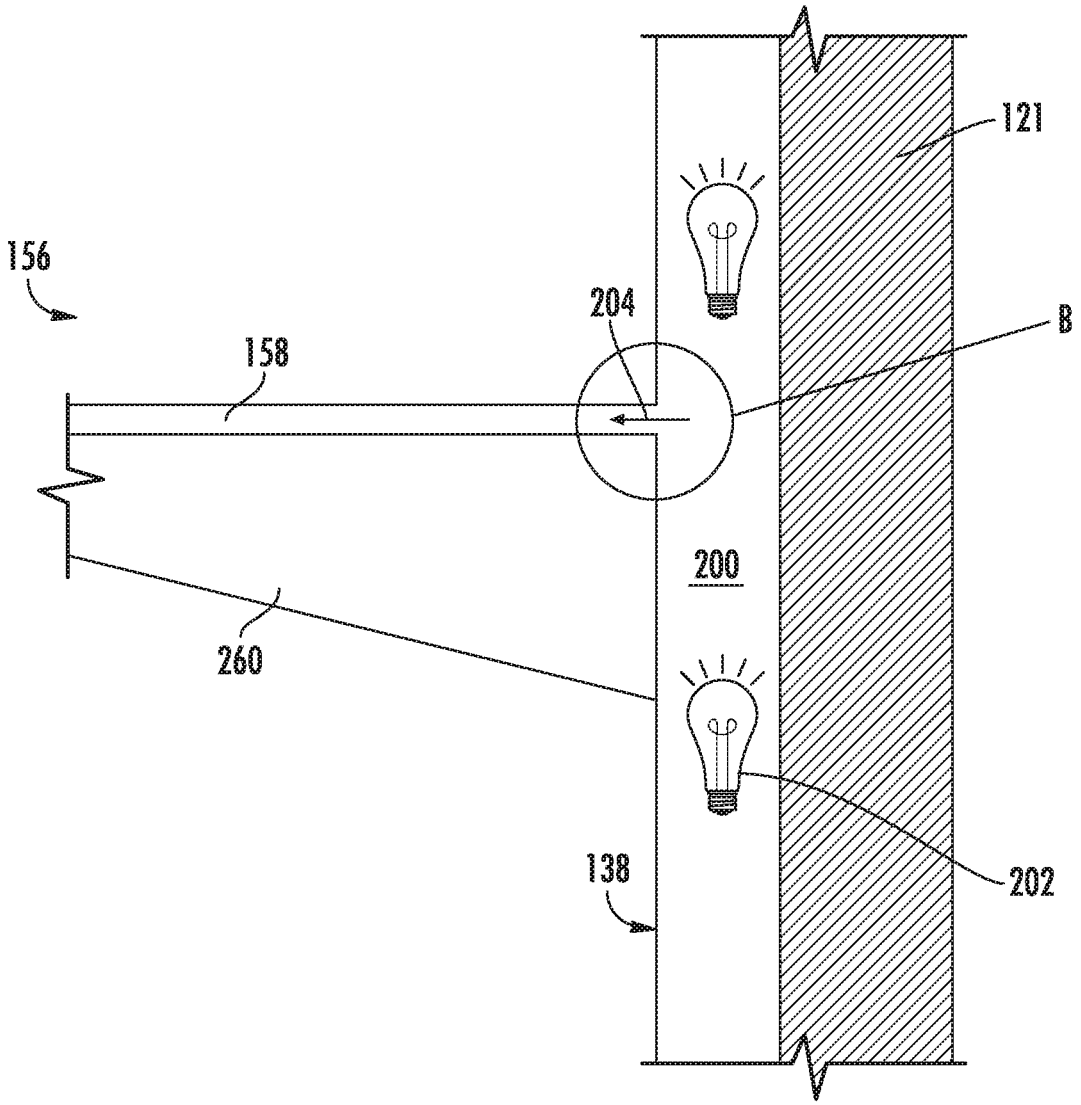
FIG. 4 provides an enlarged view of a portion of FIG. 3.

FIG. 4 provides an enlarged view of the portion of FIG. 3 indicated by the circle "A" in FIG. 3. As shown in FIG. 4, the adjustable shelf 156 includes a light-transmitting body 158, and the light-transmitting body 158 is in optical communication with the illuminated chamber 200 through the rear wall 138, such that light 204 from the light source 202 of the illuminated chamber 200 travels through the light-transmitting body 158 when the shelf 156 is mounted within the food storage chamber 122. In various embodiments, the light-transmitting body 158 may be at least translucent and may also be transparent. As shown in FIG. 4, the light 204 may travel from the illuminated chamber 200 into the light-transmitting body 158 at a location where the light-transmitting body 158 adjoins the rear wall 138.

Figure 5:
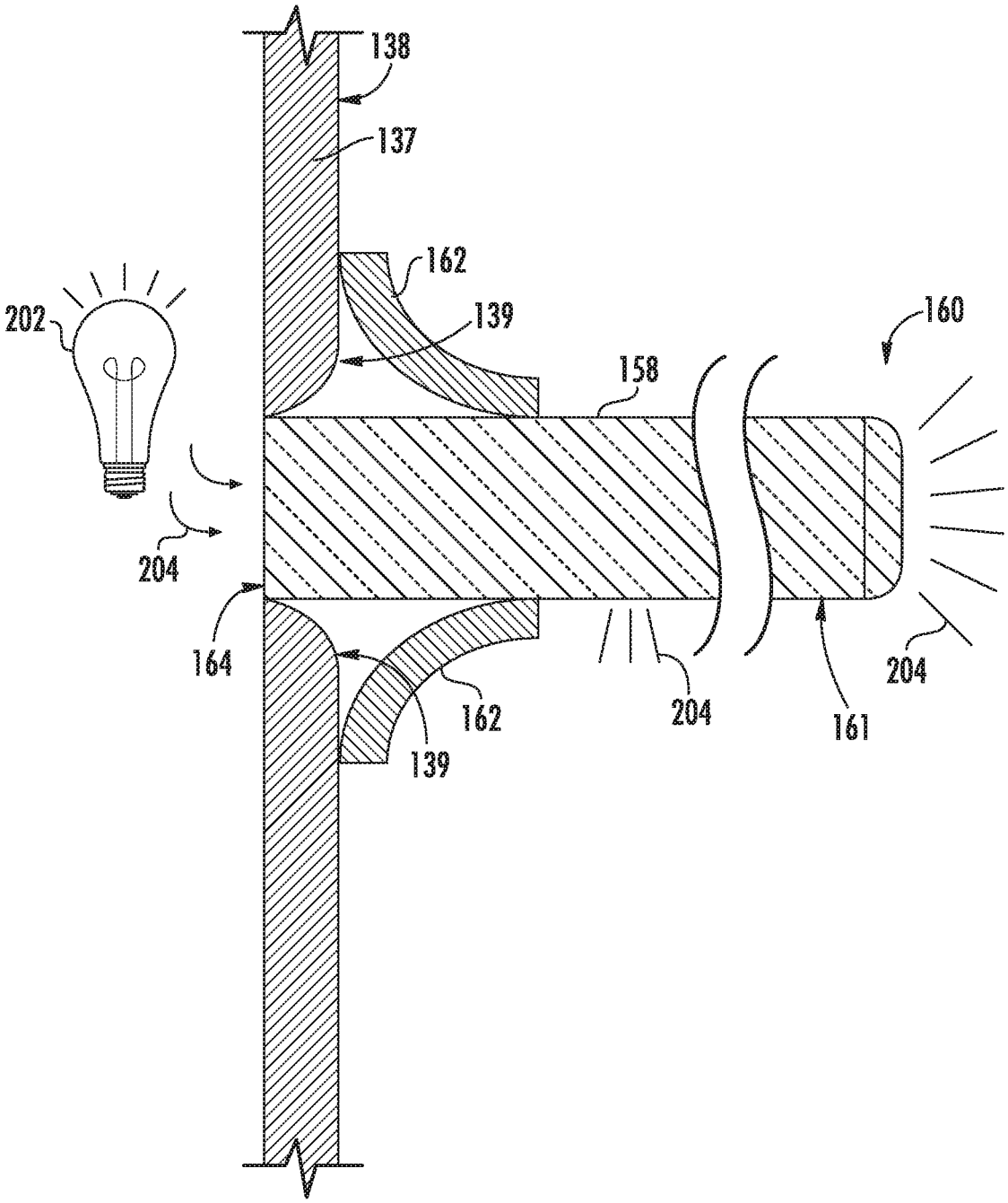
FIG. 5 provides an enlarged view of a portion of FIG. 4, including an illuminated shelf in optical communication with an illuminated chamber through a wall according to an exemplary embodiment of the present subject matter.
Figure 6:
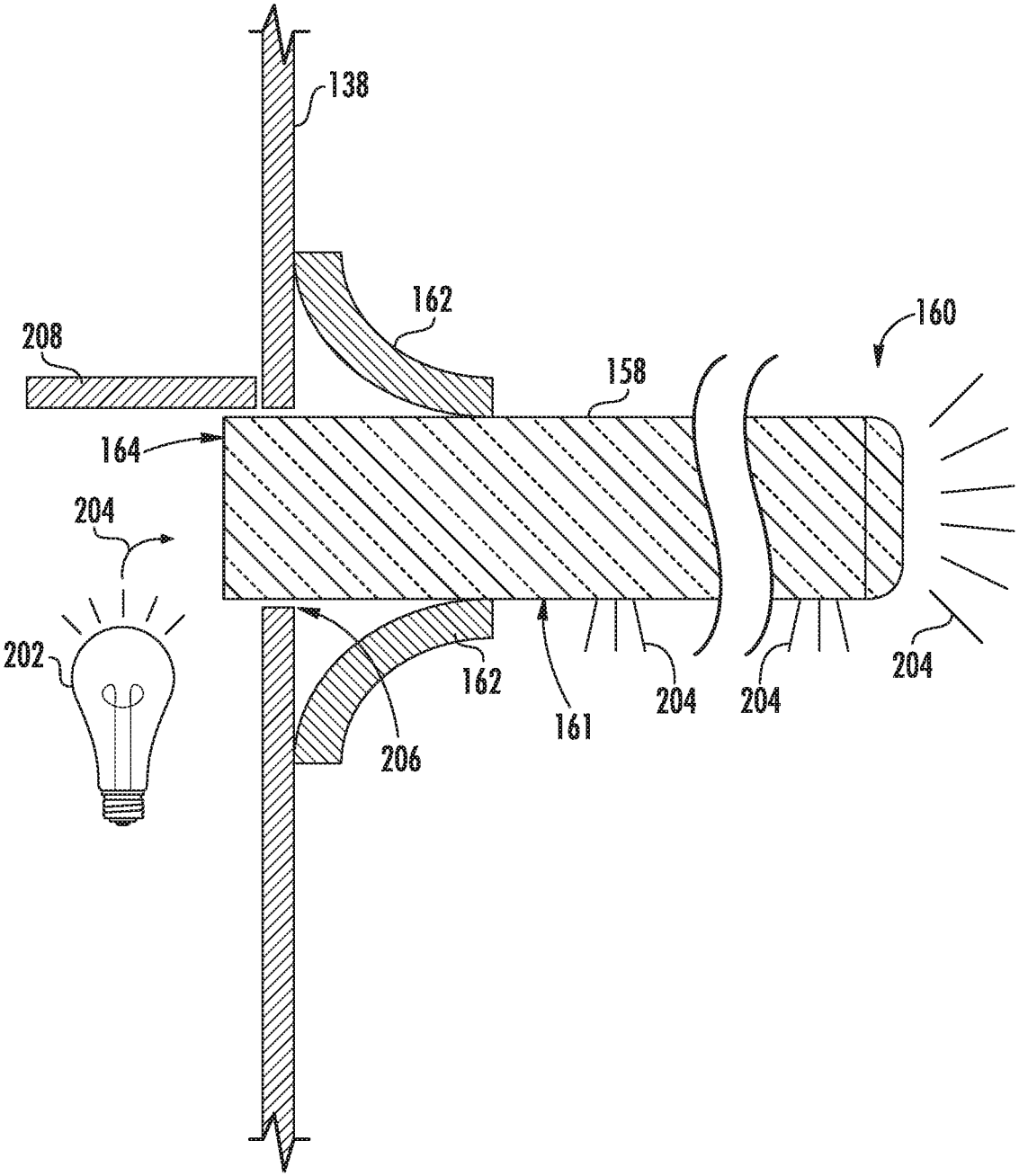
FIG. 6 provides an enlarged view of a portion of FIG. 4, including an illuminated shelf in optical communication with an illuminated chamber through a wall according to an additional exemplary embodiment of the present subject matter.
Figure 7:
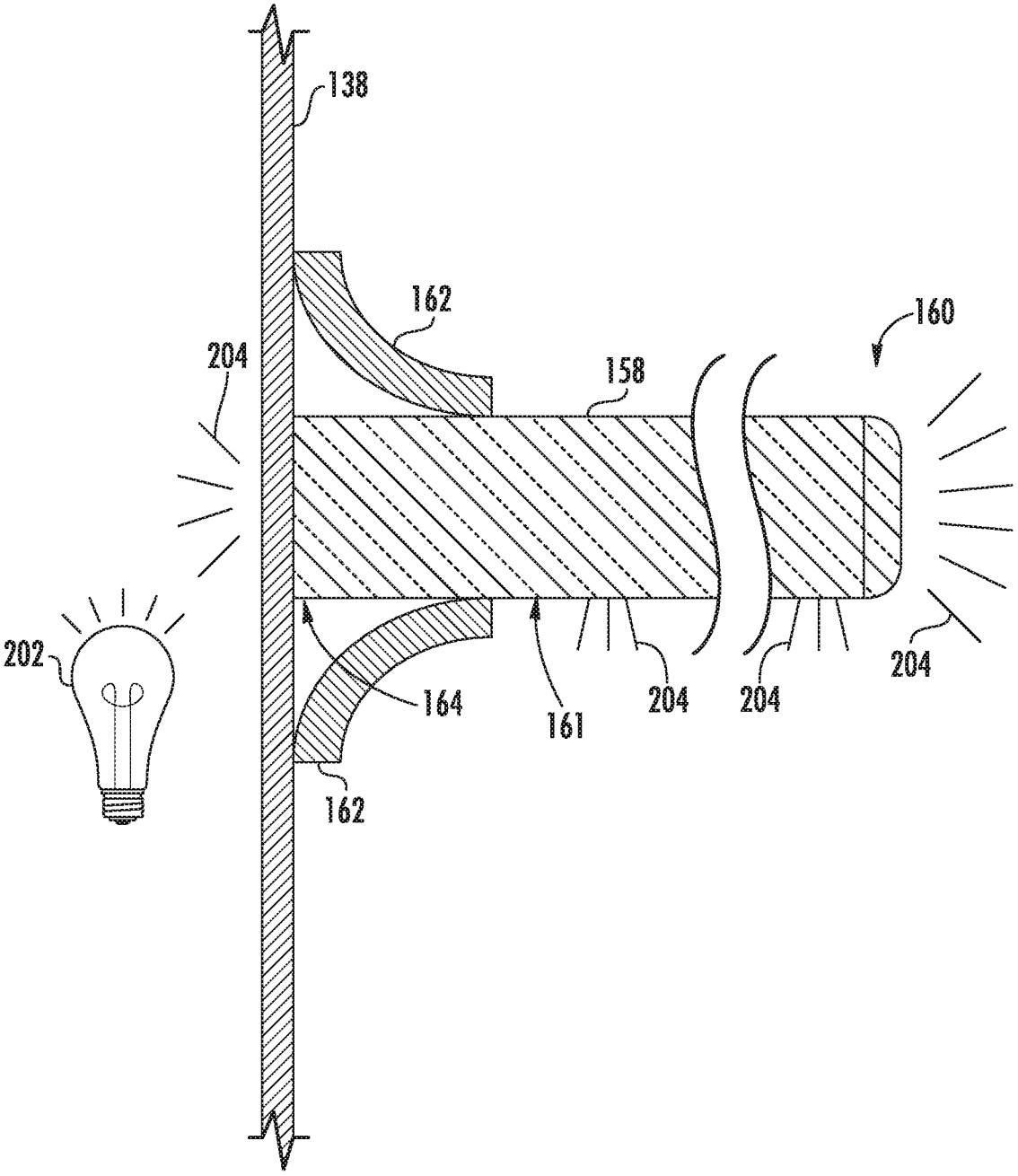
FIG. 7 provides an enlarged view of a portion of FIG. 4, including an illuminated shelf in optical communication with an illuminated chamber through a wall according to a further exemplary embodiment of the present subject matter.

FIGS. 5 through 7 illustrate an enlarged portion of FIG. 4 indicated by the circle "B" in FIG. 4. In particular, FIGS. 5 through 7 illustrate various example embodiments of the interface between the light-transmitting body 158 of the shelf 156 and the rear wall 138 which permits light 204 from the illuminated chamber 200 to enter the light-transmitting body 158 of the shelf 156. As may be seen in FIGS. 5 through 7, the light-transmitting body 158 may act as a light pipe, e.g., an edge of the shelf 156 is illuminated by the light 204 as a result of the light-transmitting body 158 being in optical communication with the illuminated chamber 200 such that the light 204 travels through the light-transmitting body 158. In some embodiments, the illuminated edge may be a front edge 160. In other embodiments, the illuminated edge may also or instead be a bottom edge 161. Also as may be seen in FIGS. 5 through 7, the shelf 156 may include at least one opaque trim member 162 adjacent to the light-transmitting body 158. For example, a first opaque trim member 162 may be provided proximate the back edge 164 of the light-transmitting body 158 at a top surface of the light-transmitting body 158, and a second opaque trim member 162 may be provided proximate the back edge 164 of the light-transmitting body 158 at a bottom surface of the light-transmitting body 158. In embodiments where the opaque trim member 162 is included, the opaque trim member 162 may provide a light guide for light 204 from the illuminated chamber 200 when the shelf 156 is mounted within the food storage chamber 122. For example, the at least one opaque trim member(s) 162 may obstruct light 204 from entering the food storage chamber around the interface between the light-transmitting body 158 and the rear wall 138 rather than through the interface between the light-transmitting body 158 and the rear wall 138.

As shown in FIG. 5, in some embodiments, the rear wall 138 may include a flexible opaque membrane 137. In such embodiments, the membrane 137 may be compressed by the light-transmitting body 158 of the shelf 156 when the shelf 156 is mounted within the food storage chamber 122. For example, as shown in FIG. 5, the light-transmitting body 158 may extend between a back edge 164 and the front edge 160, e.g., along the transverse direction T. In such embodiments, the back edge 164 of the light-transmitting body 158 may press against the opaque membrane 137 of the rear wall 138 when the shelf 156 is mounted within the food storage chamber 122, forming a compressed portion 139 of the opaque membrane 137. Accordingly, light 204 from the illuminated chamber 200 may be transmitted to the light-transmitting body 158 through the compressed portion 139 of the opaque membrane 137.

As shown in FIG. 6, in some embodiments, the rear wall 138 may include a plurality of openings 206 with a flap 208 positioned in each opening 206. FIG. 6 illustrates one example opening 206 of the plurality of openings 206, however, one of ordinary skill in the art will understand that one or more additional openings 206 similar to the example opening 206 illustrated in FIG. 6 may be provided in the rear wall 138 to correspond to each of the plurality of selectable mounting positions within the food storage chamber, e.g., each opening 206 may be located to correspond to one mounting position defined by the tracks 150 and 152, as described above. Each flap 208 may be configured to enclose the corresponding opening 206 when the shelf 156 is not present. For example, the flap 208 may be rotatably, e.g., hingedly, attached to the rear wall 138 proximate the opening 206 and may be biased, e.g., by gravity and/or a biasing element such as a spring, towards a closed position where the opening 206 is enclosed by the flap 208 and light is prevented or inhibited from travelling through the opening 206. The general structure and operation of a hinge and/or spring is well understood by those of skill in the art, accordingly, example hinges and springs are not shown or described in further detail herein for the sake of concision and clarity.

As shown in FIG. 6, the back edge 164 of the light-transmitting body 158 may be aligned with one of the plurality of openings 206 when the shelf 156 is mounted within the food storage chamber 122 such that the light-transmitting body 158 extends past the flap 208 and into the opening 206, such that the light-transmitting body 158 is in optical communication with the illuminated chamber 200 via the opening 206. For example, when the shelf 156 is installed into a selected position, light-transmitting body 158 may be aligned with the opening 206 of the plurality of openings 206 which corresponds to the selected position, such that the back edge 164 of the light-transmitting body 158 engages the flap 208 and moves, e.g., rotates, the flap 208 away from the opening 206 so that the light-transmitting body 158 may be in optical communication with the illuminated chamber 200. In such embodiments, the flap 208 is generally constructed of a rigid, opaque material. In other embodiments, the flap 208 may be constructed of a resilient flexible material, such as a self-healing material, where the flap 208 may bend away from the light-transmitting body 158 when the flap 208 is engaged by the back edge 164 as the shelf 156 is installed into the selected position. In such embodiments, the flap 208 may resiliently return to the closed position when the shelf 156 is removed.

As shown in FIG. 7, in some embodiments, the rear wall 138 may include a semi-transparent material. In such embodiments, the back edge 164 of the light-transmitting body 158 may contact, e.g., directly contact, the semi-transparent material of the rear wall 138 when the shelf 156 is mounted within the food storage chamber 122. When the shelf 156 is mounted within the food storage chamber, the light-transmitting body 158 may be in optical communication with the illuminated chamber 200 via the contact between the back edge 164 of the light-transmitting body 158 and the semi-transparent rear wall 138. Accordingly, in such embodiments, the semi-transparent rear wall 138 may permit a small portion of the light 204 to enter the food storage chamber, e.g., as a diffuse or ambient glow, throughout the rear wall 138, and a larger portion of the light 204 may be able to travel through the light-transmitting body 158 from the contact point between the semi-transparent rear wall 138 and the back edge 164 of the light-transmitting body 158. For example, the portion of the light 204 that travels through the overall rear wall 138, e.g., outside of the contact point between the back edge 164 and the rear wall 138, may be highly scattered, e.g., may be scattered at many angles, such that only a diffuse glow is provided at such locations, whereas the light 204 which travels through the light pipe, e.g., light-transmitting body 158, may be more focused, e.g., less scattered, than the portion of the light 204 that travels through the overall rear wall 138, such that the portion of the light 204 which emanates from the front edge 160 of the light-transmitting body 158 may appear brighter and/or more intense to a user than the diffuse glow.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerated appliance defining a vertical direction, a lateral direction, and a transverse direction, the vertical, lateral and transverse directions being mutually perpendicular, the refrigerated appliance comprising:

an insulated cabinet extending from a top to a bottom along the vertical direction, the cabinet also extending from a left side to a right side along the lateral direction and from a front to a back along the transverse direction, a chilled food storage chamber defined within an interior of the insulated cabinet, an opening for receipt of food items defined in a front portion of the chilled food storage chamber, and a rear wall defined in a back portion of the chilled food storage chamber, the rear wall comprising a material that is at least partially opaque or semi-transparent;

an illuminated chamber defined within the cabinet behind the rear wall, the illuminated chamber separated from the food storage chamber by the at least partially opaque or semi-transparent material of the rear wall, the illuminated chamber comprising at least one light source positioned to emit light into the illuminated chamber; and a shelf selectively mountable in one of a plurality of positions within the food storage chamber, the shelf comprising a light-transmitting body in optical communication with the illuminated chamber through the rear wall when the shelf is mounted within the food storage chamber, such that light from the light source of the illuminated chamber travels through the light-transmitting body whereby an edge of the shelf is illuminated by the light, and the shelf also comprising an opaque trim member adjacent to the light-transmitting body, the opaque trim member configured to provide a light guide for light from the illuminated chamber when the shelf is mounted within the food storage chamber.

2. The refrigerated appliance of claim 1, wherein the rear wall comprises a flexible opaque membrane, the membrane compressed by the light-transmitting body of the shelf when the shelf is mounted within the food storage chamber such that light from the illuminated chamber is transmitted to the light-transmitting body through the compressed portion of the opaque membrane.

3. The refrigerated appliance of claim 1, wherein the rear wall comprises a plurality of openings with a flap positioned in each opening, wherein the light-transmitting body of the shelf is aligned with one of the plurality of openings when the shelf is mounted within the food storage chamber such that the light-transmitting body extends past the flap and into the opening, whereby the light-transmitting body is in optical communication with the illuminated chamber via the opening.

4. The refrigerated appliance of claim 1, wherein the rear wall comprises a semi-transparent material, wherein a back edge of the light-transmitting body contacts the semi-transparent material when the shelf is mounted within the food storage chamber and is in optical communication with the illuminated chamber via the contact between the back edge of the light-transmitting body and the semi-transparent rear wall.

5. The refrigerated appliance of claim 1, wherein the appliance is a standalone refrigerator appliance consisting of a single food storage chamber, and the single food storage chamber is configured for storing fresh food items at temperatures greater than zero degrees Celsius.

6. The refrigerated appliance of claim 1, wherein the appliance is a standalone freezer appliance consisting of a single food storage chamber, and the single food storage chamber is configured for storing frozen food items at temperatures less than or equal to zero degrees Celsius.

7. The refrigerated appliance of claim 1, wherein the illuminated chamber is coextensive with the chilled food storage chamber.

8. The refrigerated appliance of claim 1, wherein the chilled food storage chamber is a fresh food storage chamber configured for storing fresh food items at temperatures greater than zero degrees Celsius, the refrigerated appliance further comprising a freezer chamber configured for storing frozen food items at temperatures less than or equal to zero degrees Celsius.

9. The refrigerated appliance of claim 8, wherein the shelf is selectively mountable within the fresh food storage chamber or the freezer chamber.

10. A refrigerated appliance, comprising:

an insulated cabinet defining a chilled food storage chamber within an interior of the insulated cabinet;

an opening defined in a front portion of the insulated cabinet, the opening providing access to the chilled food storage chamber;

an illuminated chamber defined within the cabinet, the illuminated chamber separated from the chilled food storage chamber by a wall of the chilled food storage chamber positioned opposite the opening, the wall of the chilled food storage chamber comprising a material that is at least partially opaque or semi-transparent;

at least one light source positioned to emit light into the illuminated chamber; and a shelf selectively mountable in one of a plurality of positions within the food storage chamber, the shelf comprising a light-transmitting body in optical communication with the illuminated chamber when the shelf is mounted within the food storage chamber, such that light from the light source of the illuminated chamber travels through the light-transmitting body whereby a first edge of the shelf is illuminated by the light, and an opaque trim member adjacent to the light-transmitting body, the opaque trim member configured to provide a light guide for light from the illuminated chamber when the shelf is mounted within the food storage chamber;

wherein light from the illuminated chamber is inhibited from travelling into the chilled food storage chamber by the wall, except via the light-transmitting body of the shelf.

11. The refrigerated appliance of claim 10, wherein the wall comprises a flexible opaque membrane, the membrane compressed by the light-transmitting body of the shelf when the shelf is mounted within the food storage chamber such that light from the illuminated chamber is transmitted to the light-transmitting body through the compressed portion of the opaque membrane.

12. The refrigerated appliance of claim 10, wherein rear wall comprises a plurality of openings with a flap positioned in each opening, wherein the light-transmitting body of the shelf is aligned with one of the plurality of openings when the shelf is mounted within the food storage chamber such that the light-transmitting body extends past the flap and into the opening, whereby the light-transmitting body is in optical communication with the illuminated chamber via the opening.

13. The refrigerated appliance of claim 10, wherein the wall comprises a semi-transparent material, wherein a second edge of the light-transmitting body contacts the semi-transparent material when the shelf is mounted within the food storage chamber and the light-transmitting body is in optical communication with the illuminated chamber via the contact between the second edge of the light-transmitting body and the semi-transparent wall.

14. The refrigerated appliance of claim 10, wherein the appliance is a standalone refrigerator appliance consisting of a single food storage chamber, and the single food storage chamber is configured for storing fresh food items at temperatures greater than zero degrees Celsius.

15. The refrigerated appliance of claim 10, wherein the chilled food storage chamber is a fresh food storage chamber configured for storing fresh food items at temperatures greater than zero degrees Celsius, the refrigerated appliance further comprising a freezer chamber configured for storing frozen items at temperatures less than or equal to zero degrees Celsius.

16. The refrigerated appliance of claim 10, wherein the illuminated chamber is coextensive with the chilled food storage chamber.

17. The refrigerated appliance of claim 10, wherein the appliance is a standalone freezer appliance consisting of a single food storage chamber, and the single food storage chamber is configured for storing frozen food items at temperatures less than or equal to zero degrees Celsius.

18. The refrigerated appliance of claim 17, wherein the shelf is selectively mountable within the fresh food storage chamber or the freezer chamber.

* * * * *